United States Patent [19]

Cumbers

[11] 4,005,169

[45] Jan. 25, 1977

[54] NON-WOVEN FABRICS

[75] Inventor: David Charles Cumbers, Harrogate, England

[73] Assignee: Imperial Chemical Industries Limited, London, England

[22] Filed: Apr. 17, 1975

[21] Appl. No.: 568,837

[30] Foreign Application Priority Data

Apr. 26, 1974 United Kingdom ..... 18326/74

[52] U.S. Cl. ..... 264/103; 264/119; 264/284; 264/293

[51] Int. Cl.[2] ..... B29D 3/02

[58] Field of Search ..... 264/293, 284, 119, 175, 264/103

[56] References Cited

UNITED STATES PATENTS

| | | | |
|---|---|---|---|
| 3,120,449 | 2/1964 | Griswold | 264/175 X |
| 3,255,064 | 6/1966 | Makansi | 264/119 X |
| 3,272,898 | 9/1966 | Knee | 264/119 |
| 3,507,943 | 4/1970 | Such | 264/119 X |
| 3,607,992 | 9/1971 | Scheiding | 264/293 X |
| 3,692,622 | 9/1972 | Dunning | 264/119 X |

FOREIGN PATENTS OR APPLICATIONS

| | | | |
|---|---|---|---|
| 45-3237 | 1970 | Japan | 264/284 |

*Primary Examiner*—Richard R. Kucia
*Attorney, Agent, or Firm*—Cushman, Darby & Cushman

[57] ABSTRACT

A method for making a segmentally thermally bonded non woven fabric by compressing a fibrous web between heated members with different surface land patterns of isolated projections which overlap with each other to different extents in defined manner so that registration problems are avoided in manufacture and a complex surface texture is produced in the fabric.

14 Claims, 10 Drawing Figures

NON-WOVEN FABRICS

This invention relates to processes for making segmentally bonded non woven fabrics.

It is known to make segmentally bonded fabrics by hot calendering thermally bondable fibre webs between a plain roll and a roll with a patterned surface of lands between depressions. An appropriately patterned roll can be used to produce any desired pattern of heavily or primary bonded segments where a fabric is nipped between the rolls during calendering; but the plain roll also tends to cause some less heavy or secondary bonding over the remainder of the fabric where it has not been nipped between the rolls. This secondary bonding tends to stiffen the fabric.

It is also known to make segmentally bonded fabrics using two patterened calender rolls, the two patterns taking the form of rings or helices which cannot intermesh. Such processes do not cause secondary bonding over the whole of the fabric, but only at those places where the fabric has touched a land on one or the other roll. However, this more limited secondary bonding is achieved at the expense of the disadvantage that only a limited range of regular patterns of primary bonds can be produced, at the land cross over points as the rolls rotate.

Calendering a web between two rolls each bearing patterns of lands which were maintained sufficiently accurately in register with each other could produce any desired pattern of both primary and secondary bonding; but maintenance of such accurate register is not practicable, or is at best very expensive, when using rolls big enough to produce wide fabrics, and lands small enough to produce fabrics with useful properties and pleasing appearance.

We have now discovered a new method of making segmentally bonded fabrics which overcomes these various problems of excessive secondary bonding, pattern limitation and engineering feasibility; and the method of applicable to bonding by compression between co-operating members such as plates or belts as well as rolls.

According to the present invention an improved method of making a thermally segmentally bonded non woven fabric comprises compressing a fibrous web containing distributed thermally bondable material between two members whose co-operating surfaces each have different surface land patterns of isolated projections, in which the lands are heated sufficiently to activate the thermally bondable material in contact with them, and opposed pairs of lands, one on each member, differ from at least some other such pairs of lands in their degrees of relative register in two directions at right angles to each other, whereby alterations in the relative register between the members as a whole in each of the said two directions cause increases in the degrees of overlap between some overlapping pairs of lands as well as decreases in the degrees of overlap between other overlapping pairs of lands.

Any opposed pairs of lands which overlie each other in perfect register will compress the web between them over their full area or over the full area of the smaller land if the two lands of the pair are unequal. Opposed pairs of lands which have a lesser degree of register and only overlap will compress the web to form a primary bond only in that portion of their areas where they overlie each other and they will cause secondary bonding where they do not overlie. Variation in degree of register can clearly result in some lands not even overlapping their corresponding nearest opposing lands on the other member and such lands then cause only secondary bonding.

The two-dimensional de-registration requirement of the invention has various consequences. Since different land pairs overlap to different extents, the pattern of resultant primary bonds is not regular but is a complex superposition interference pattern even though each land pattern may be simple, regular and cheap to manufacture. Such non regular bond patterns are not only in themselves more visually attractive than regular ones; they have the further advantage that fluctuations in relative register between the members as a whole do not cause such obvious differences in fabric appearance as they would if all the land pairs were in the same relative register as their neighbours, and produced a regular bond pattern. Furthermore, if the lands on one member are small enough to fit into the depressions between lands on the other member, so that the members could in certain conditions of mutual register fall into intermesh, then the double de-registration requirement of the invention prevents intermesh from arising as a result of fluctuations in relative register between the members as a whole. Preferably, the differences in register between different pairs of opposed lands range in each direction from zero to half of the corresponding interland spacing so that the members cannot intermesh whatever their mutual register as a whole. In this preferred circumstance the pattern of primary bonds contains some large bonds resulting from fully facial contact between some lands, and some very small bonds resulting from only glancing contact between other lands; and this provides a visually interesting fabric texture which is not visibly altered by any fluctuations in relative register between the members as a whole.

The members between which the web is compressed are preferably calender rolls. The use of two rolls each having a land pattern comprising closed echelons of lands inclined to the nip is particularly to be preferred from the point of view of runnability because with such patterns there are always some land pairs in face to face contact in the line of the nip which serve to withstand the nip pressure without permitting the rolls to bounce or chatter, as must occur at least to some degree whenever one roll bears a pattern which can instantaneously present a depression between lands right along the nip line. However, with sufficiently large diameter rolls and sufficiently small lands it is possible to use rolls which do not avoid such bounce or chatter because the effect can be sufficiently small.

Various land distributions and derived primary bond segment patterns according to the invention will now be described by way of example with reference to the drawings accompanying the provisional specification in which.

Figure 3:
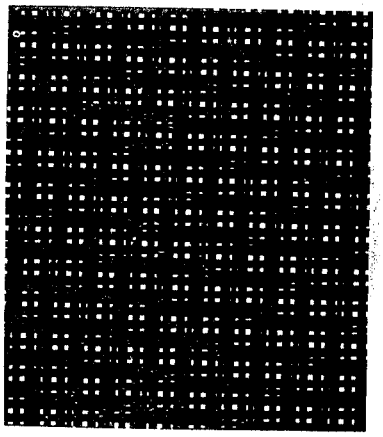
FIG. 3 represents a primary bond segment pattern derived from two roll patterns, one of which comprises the land distribution of FIG. 1 lined up axially and circumferentially and the other of which comprises the land distribution of FIG. 2 at a skew angle of 3° from the axial and circumferential directions.
Figure 4:
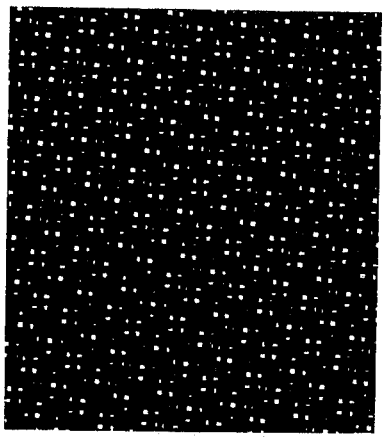
FIG. 4 represents a primary bond segment pattern derived in the same way as the pattern of FIG. 3 but with a skew angle of 15°.

If distributions 1 and 2, one on each calender roll, are both lined up axially and circumferentially on their rolls, then because the spacing of the lands is different on the two rolls the degree of register between opposed pairs of lands in the nip will differ along the length of the nip so that axial register of the rolls as a whole does not need to be maintained in order to avoid a regular bond pattern in the lateral direction, or to avoid damage due to glancing contacts or to avoid the possibility of inter-meshing. However if rolls bearing such land patterns were rotated, successive rows of lands across the nip would become simultaneously more and more out of register in the circumferential direction so that they would all at the same time reach the stage of glancing contact or possible intermeshing. This can be avoided by skewing the distribution of lands on one roll so that the degrees of register between pairs of lands opposing each other in the nip differ not only in the axial direction but also in the circumferential direction. The primary bond pattern derived from such an arrangement with a skew angle of 3° is illustrated in FIG. 3. Preferably, in order to improve runnability, the land distributions are both slightly skewed, but at skew angles differing by 3°, to produce the bond pattern of FIG. 3 at a slight angle to the fabric edges. The possibility of obtaining various patterns of primary bond segments from such simple machinable roll patterns is illustrated by FIG. 4 is which the skew angle between the distributions has been increased to 15°.

Figure 1:
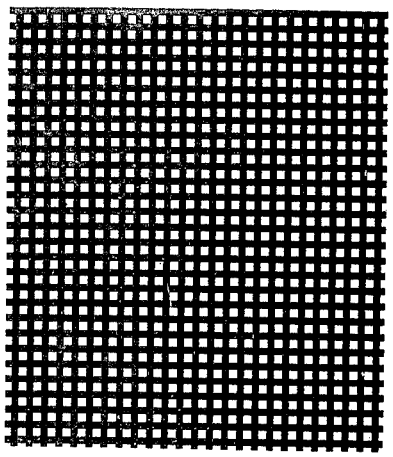
FIG. 1 represents a simple chequerboard distribution of square lands.
Figure 2:
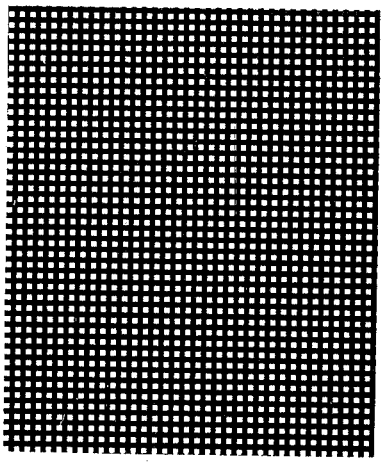
FIG. 2 represents a second chequerboard distribution of square lands with a different size and spacing.
Figure 5:
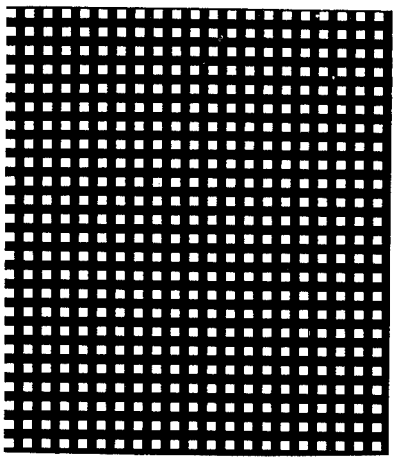
FIG. 5 represents a third chequerboard distribution of square lands with size and spacing bigger than the distributions of FIGS. 1 and 2.
Figure 6:
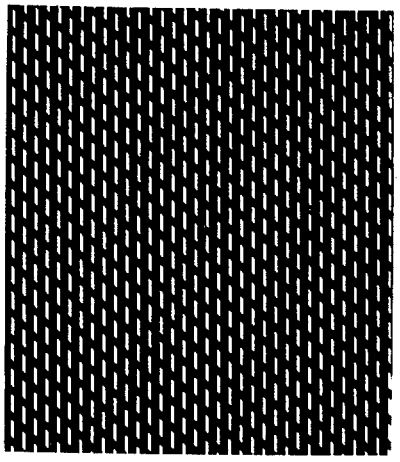
FIG. 6 represents a distribution of parallelogram-shaped lands in echelon formation.
Figure 7:
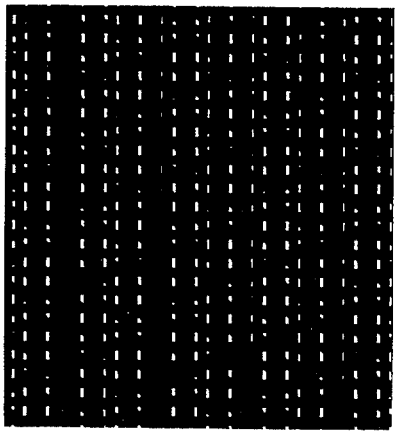
FIG. 7 represents a primary bond segment pattern derived from two roll patterns comprising the land distributions of FIGS. 5 and 6, each lined up axially and circumferentially on its roll.

When such a skew angle is used it is not necessary to use different land distributions like those of FIGS. 1 and 2 in order to meet the double register requirement of the invention. It is possible to use two rolls with patterns based on the same distribution and differing only in skew angle. The effect of a small skew angle is to cause a row of projections in one of these chequerboard land distributions to be in closed echelon rather than in line along the nip line between the rolls. When one of the land distributions itself comprises projections in echelon a skew angle is not necessary in order to meet the register requirement of the invention. This is illustrated by the distributions of FIGS. 5 and 6 which combine successfully without a skew angle to produce the bond pattern illustrated in FIG. 7. The land distribution of FIG. 6 would only lead to departure from the invention if used to produce a roll pattern at a skew angle which caused the line of the nip to be close to either of the directions of the lines A B or C D of FIG. 6. In either of these cases a skew angle would be needed in the co-operating roll pattern based on the land distribution of FIG. 5.

Figure 8:
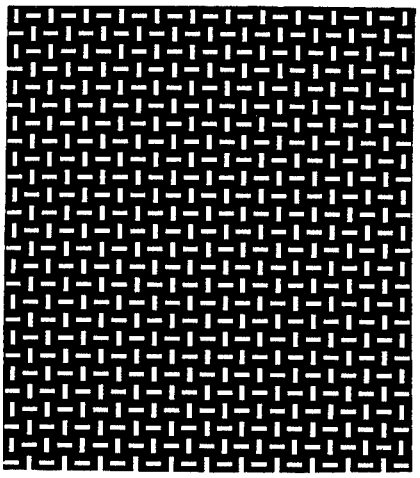
FIG. 8 represents a distribution of lands which cannot be made by simple machining of a roll surface but which can be made by etching.
Figure 9:
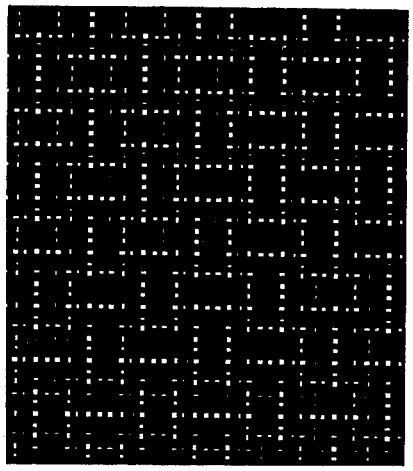
FIG. 9 represents a primary bond segment pattern derived from two roll patterns comprising the land distributions of FIGS. 2 and 8, each lined up axially and circumferentially on its roll.
Figure 10:
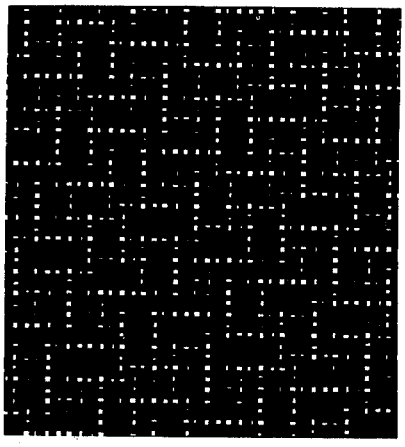
FIG. 10 represents a bond segment pattern corresponding to that of FIG. 9 but with a skew angle of 3°.

FIG. 8 represents a non machinable land pattern distribution which can co-operate with the distribution of FIG. 2 at any skew angle and satisfy the register requirements of the invention. FIGS. 9 and 10 illustrate primary bond patterns derived from roll patterns using the land distributions of FIGS. 2 and 8 at 0° and 3° skew angles respectively.

In this example a long land of FIG. 8 can co-operate with two square lands of FIG. 2 to form two opposed land pairs in different relative registers: and because different long lands extend in different directions there are differences in relative register in both axial and circumferential directions between some different land pairs whether the distributions are at zero or any other skew angle.

Preferably the calender rolls have substantially parallel axes and any skew angle required between land distributions is provided by cutting a suitably skewed land pattern on at least one roll; but with large rolls and closely spaced land patterns it is possible to provide sufficient skew angle by slightly skewing one roll axis with respect to the other, if necessary profiling the rolls to provide sufficiently constant pressure along the nip line despite the skew angle.

Possible fabric designs can conveniently be explored using land distributions printed photographically as black and clear transparencies and superimposing them in pairs at various angles to produce different superposition interference patterns as in the figures. Attractive patterns can then be chosen and the machining or engraving specifications can be laid down for two co-operating calender rolls to produce the selected primary bonding pattern.

The process of the invention may be applied to webs of continuous filaments or staple fibres or both. The thermally bondable material in the web may be formed from a thermoplastic polymer with a softening lower than the softening point of fibres compressing the web. The bondable material may itself be in fibre form and is preferably in the form of bicomponent fibres with a sheath which softens during bonding and a higher melting point core which does not soften during bonding. Other fibres in the web may be of any kind, natural or synthetic, and any method may be employed for preparing the web. A web made from at least some uncrimped fibres is preferred because the resultant fabric is then stronger.

In order to illustrate the invention in more detail various specific processes will now be described by way of example. In these processes five land patterns were used and these were produced as follows:

Pattern 1, of the kind illustrated in FIG. 6, was made by two cutting operations; firstly, helical milling to a depth of 0.045 – 0.50 inch produced a groove with a circumferential pitch of 0.0152 inch and a circumferential width of 0.025 inch leaving a continuous land of circumferential width 0.127 inch, and secondly, cutting a single start right-hand thread with an axial pitch of 0.062 inch to the same depth leaving isolated lands with an axial width of 0.034 inch.

Pattern 2, of the kind illustrated in FIGS. 1, 2 and 5, was also made by two cutting operations; firstly, a single start righthand thread cut to a depth of 0.030 inch produced a groove with an axial pitch of 0.071 inch and an axial width of 0.048 inch leaving a land with an axial width of 0.023 inch; and secondly, horizontal milling of grooves in the axial direction and of similar depth left isolated lands with a circumferential width of 0.023 inch.

Pattern 3 was made by cutting a 14 start right-hand thread with a lead of 1.4 inch providing 10 continuous lands per inch each with an axial width of 0.068 inch and then by left-hand knurling at 14 threads per inch inclined at 3° to the axial direction leaving isolated lands with a circumferential width of 0.030 inch. This provides a pattern similar to that of FIG. 5 except that the lands, instead of being square, are rectangular with their length substantially in the axial direction but skewed from it by a small angle of 3°.

Pattern 4 was made by cutting a single start left-hand thread at 14 threads per inch leaving a continuous land of axial width 0.030 inch and then horizontal milling grooves in the axial direction leaving isolated lands with a circumferential width of 0.068 inch. This provides a pattern rather like Pattern 3 but with the land length in the circumferential direction.

Pattern 5, of the kind illustrated in FIG. 8, was made by engraving, leaving lands with tip dimensions of 0.036 inch × 0.105 inch spaced apart at their positions of closet approach by 0.031 inch.

EXAMPLE 1

Polyamide bicomponent filaments having a core of poly(hexamethylene adipamide) surrounded by a sheath of poly(epsilon caprolactam), the components being present in equal volumes, were melt spun, drawn to a decitex of 3.3, mechanically crimped in a stuffer-box crimper to 6 crimps per cm at a crimp ratio of 20% and cut into 50 mm lengths. The stapel fibres thus produced were formed into a web, weighing 150 g $m^{-2}$, by means of conventional airdeposition equipment (Rando-Webber manufactured by Curlator Corporation). The web was consolidated by a light needle-punching with 36 gauge 5 barb needles, arranged in a random pattern in a needle board, the needles penetrating the web to a depth of 10 mm. The web was passed through the needle loom at a rate which ensured about 46 needle penetrations per square centimetre.

The consolidated web was subsequently treated by heat and pressure in a nip between rolls of a calender. The upper roll was a rigid steel tube and the lower roll was a thin walled steel tube with an outer diameter of 5.020 inches and an inner diameter of 4.498 inches which could conform to localised and transitory variations in the nip pressure to ensure the nip pressure was maintained at a substantially uniform level as disclosed in our co-pending application 2394/73. The top roll bore pattern 1 and the bottom roll bore pattern 2. Both were heated to 217° C. and urged together at a nip pressure of 88 lbs per linear inch. The web was passed through the nip at 10 ft/min.

The conditions in the nip caused the sheath component of the fibres to become adhesive whilst the core component remained unaffected, and on cooling bonds formed between contiguous fibres.

A portion of the product was thereafter dyed and its properties were found to be as follows:

Table 1

| Property | Greige fabric | Dyed fabric |
|---|---|---|
| Weight g/m² | 126 | 154 |
| Drape coefficient (%) (1) | 83 | 62 |

Table 1-continued

| Property | Greige fabric | Dyed fabric |
|---|---|---|
| Breaking load (Kg) | | |
| MD (2) | 7.1 | 8.1 |
| CD (2) | 6.7 | 9.5 |
| Extension at break (%) | | |
| MD | 28 | 43 |
| CD | 38 | 46 |
| Breaking strength (Kg/g/cm) | | |
| MD | 213 | 206 |
| CD | 187 | 244 |
| Tear load (Kg) | | |
| MD | 2.1 | 3.4 |
| CD | 2.3 | 3.1 |
| Tear factor (Kg/g/m²) | | |
| MD | 0.015 | 0.022 |
| CD | 0.017 | 0.020 |

(1) Measured by the method of Cusick J Text Inst. 1968, 59, T253
(2) MD = measured along the length of the product. CD = measured across the width of the product.

EXAMPLE 2

Staple bicomponent fibres having a core of poly(ethylene terephthalate) surrounded by a sheath of a polyester copolymer (15 mole percent ethylene isophthalate/ethylene terephthalate), the ratio of core to sheath being 67:33 by volume, were melt spun, drawn to a decitex of 3.3, mechanically crimped in a stuffer box to a level of 6 crimps per centimetre at a crimp ratio of 33% and cut into 50 mm lengths.

A web was formed from these fibres using a card to form a batt which was subsequently cross-lapped to form a web weighing 150 g.$m^{-2}$. The web was consolidated by needle-punching with 36 gauge needles randomly arranged in a needle board the needle penetration being 10 mm. The web received 23 needle punches per square centimetre from both sides making a total of 46 punches per square centimetre.

Subsequently the web was bonded using the calender press described in Example 1. All conditions were identical to those set forth in Example 1 except that the rolls were heated to 195° C.

The bonded product had the following properties:

Table 2

| Property | Greige fabric | Dyed fabric |
|---|---|---|
| Weight g/m² | 128 | 140 |
| Drape coefficient (%) | 92 | 66 |
| Breaking load (kg) | | |
| MD | 5.2 | 4.4 |
| CD | 6.6 | 6.7 |
| Extension at break (%) | | |
| MD | 33 | 39 |
| CD | 52 | 60 |
| Breaking strength (Kg/g/cm) | | |
| MD | 154 | 126 |
| CD | 211 | 194 |
| Tear load (Kg) | | |
| MD | 2.2 | 2.4 |
| CD | 1.8 | 1.8 |
| Tear factor (Kg/g/m²) | | |
| MD | 0.017 | 0.017 |
| CD | 0.014 | 0.013 |

EXAMPLES 3 TO 6

Webs with the composition shown in Table 3 were prepared as in Example 2, calendered as shown at a nip pressure of 175 lb per inch and yielded fabrics with the properties listed, and with pleasing bonding pattern and texture. The blend of single component and bicomponent fibres in Example 6 is remarkable in that it yields a lower drape coefficient than the polyamide webs of the other examples. Similarly a blend of single component and bicomponent polyester fibres gives unexpectedly good drape, although polyester fabrics as a whole tend to be stiffer than polyamide fabrics.

EXAMPLE 7

Melt spun and drawn bicomponent 4 decitex filaments with a core of nylon 66, a sheath of nylon 6, and a sheath/core ratio of 35/65% by weight; and having a tenacity of 2.5 grams per decitex and an elongation of 120%; were randomly laid to form a web with a weight of 70 grams per square metre.

The web was calendered between rolls bearing patterns 3 and 4, heated to 195° C. and urged together at a nip pressure of 125 lb per linear inch. The resultant fabric had a pleasing surface texture, drape coefficients of 57% and 64% face up and face down respectively, and tear strengths of 1.8 and 1.5 kg in the machine and cross directions.

EXAMPLES 8 TO 14

Samples of bicomponent fibre were made as in Example 2, and corresponding samples were left uncrimped. Some of these samples were dressed with 0.1% of finely divided silica in addition to a conventional fatty alcohol/ethylene oxide condensate processing aid and the samples were cut to two staple lengths of 38 mm and 56 mm. Webs of uncrimped fibre were made by carding followed by laying in a Rando Webber followed by light needling to provide enough coherence for the web to be fed into the bonding calender which was operated at 195° C. and 175 lb per inch nip pressure. Tables 4 and 5 show that the uncrimped fibres produced stronger fabric and that the reduction of fibre friction by adding silica produced stronger fabric. A blend of uncrimped and crimped fibre, or a fibre with a low level of crimp below 2 crimps per centimetre, may be used to reach a compromise between the difficulty of producing a uniform web and the achievement of a higher fabric strength.

Table 3

| Web | Example 3 | Example 4 | Example 5 | Example 6 |
|---|---|---|---|---|
| Composition | 100% nylon 6<br>6.7 d.tex<br>72.6 mm.<br>11.6 crimps/cm<br>24.2% crimp ratio | (i) 50% nylon 6 as in Example 3.<br>(ii) 50% nylon 66<br>6.7 d.tex<br>50.8 mm.<br>15 crimps/cm<br>18.4% crimp ratio | (i) 50% polyamide bicomponent fibre as in Example 1.<br>(ii) 50% slipe wool. | (i) 50% polyamide bicomponent as in Example 1.<br>(ii) 50% nylon 66 as in Example 4. |
| Weight g/m² | 141 | 126 | 142 | 155 |
| Calendering Conditions | | | | |
| Temperature ° C | 200 | 217 | 217 | 217 |
| Top Roll | 3 | 3 | 5 | 5 |
| Bottom Roll | 4 | 4 | 4 | 2 |
| Fabric Properties | | | | |
| Breaking load (kg) | | | | |
| MD | 11 | 9.8 | 9.9 | 12.7 |
| CD | 5.7 | 12.8 | 6.3 | 9.9 |
| Extension at break (%) | | | | |
| MD | 38 | 24 | 27 | 35 |
| CD | 23 | 39 | 48 | 49 |
| Breaking strength (Kg/g/cm) | | | | |
| MD | 108 | 160 | 136 | 159 |
| CD | 84 | 193 | 88 | 126 |
| Tear load (Kg) | | | | |
| MD | 1.0 | 1.3 | 1.4 | 2.5 |
| CD | 0.8 | 1.1 | 1.5 | 2.8 |
| Tear strength (g/g/m²) | | | | |
| MD | 7 | 10.9 | 10 | 17.2 |
| CD | 6 | 8.9 | 11 | 16.8 |
| Drape coefficient | | | | |
| Face up | 62 | 77 | 71 | 59 |
| Face down | 71 | 80 | 75 | 51 |
| Mean | 67 | 78 | 73 | 55 |

Table 4

| | | Example 8 | Example 9 | Example 10 | Example 11 |
|---|---|---|---|---|---|
| Staple length | | 56 mm | 56 mm | 38 mm | 38 mm |
| crimp | | Uncrimped | 3.5 crimps/cm | Uncrimped | 3.9 crimps/cm |
| Weight g/m² | | 129 | 153.5 | 155.0 | 104.6 |
| Breaking load | MD | 29 | 22 | 39.0 | 16.8 |
| Kg | | | | | |
| (30 × 5 cm) | CD | 11.2 | 18.6 | 26.0 | 10.2 |
| Extension at | MD | 26 | 28 | 29 | 25 |
| Break % | CD | 27 | 23 | 22 | 25 |
| Breaking strength | MD | 455 | 300 | 503 | 329 |
| Kg/gm/cm | CD | 407 | 242 | 437 | 199 |
| Tear load | MD | 1.4 | 1.8 | 1.7 | 1.0 |
| Kg | CD | 1.6 | 1.7 | 2.2 | 1.5 |
| Tear strength | MD | 11.0 | 11.5 | 15.0 | 10.1 |

Table 4-continued

| | | Example | | | |
|---|---|---|---|---|---|
| | | 8 | 9 | 10 | 11 |
| g/g/m² | CD | 12.4 | 10.8 | 19.1 | 14.0 |

Table 5

| | | Example | | |
|---|---|---|---|---|
| | | 12 | 13 | 14 |
| | | 56 mm Crimped | 56 mm Crimped + Silica in Spin Finish | 56 mm Uncrimped + Silica in Spin Finish |
| Weight g/m² | | 153.5 | 163.5 | 144.8 |
| Breaking load | MD | 22.8 | 22.4 | 28.7 |
| Kg | CD | 18.6 | 15.3 | 19.4 |
| Extension at break | MD | 28 | 24 | 24 |
| % | CD | 23 | 25 | 17 |
| Breaking strength | MD | 300 | 284 | 396 |
| Kg/gm/cm | CD | 242 | 190 | 269 |
| Tear load | MD | 1.8 | 2.1 | 2.7 |
| Kg | CD | 1.7 | 2.5 | 2.2 |
| Tear strength | MD | 11.5 | 12.8 | 17.6 |
| g/g/m² | CD | 10.8 | 15.0 | 15.9 |

All these examples were carried out on a 1 meter wide calender with a 7¾ inch diameter upper roll and a 5 inch diameter lower roll, but the process of the invention is readily applicable to larger calenders. In these examples the percentage of the fabric area occupied by primary bonds, calculated as the product of the percentages of the areas of the rolls occupied by lands, is as shown in Table 6. High bond areas tend to produce stiffer fabrics and low bond areas tend to produce less coherent fabrics.

Table 6

| Patterns | Land Areas | Product of Land Areas | Ratio of Land Areas |
|---|---|---|---|
| 1 on 2 | 46% and 10% | 4.6% | 4.6 |
| 3 on 4 | 28% and 28% | 8.0% | 1.0 |
| 5 on 4 | 25% and 28% | 7.0% | 1.1 |
| 5 on 2 | 25% and 10% | 2.5% | 2.5 |

Furthermore the same primary bond area can be produced by rolls with equal land areas or by rolls with unequal land areas which cause greater secondary bonding on one face, increasing fabric stiffness, and at the same time less secondary bonding on the other face, reducing resistance of the fabric to abrasion and pilling.

It is therefore preferable to use equal land areas giving fabrics with balanced bonding on the two faces. However, strict adherence to balanced bonding causes unnecessary restriction on choice of patterns, and proves to be unnecessary. Different end uses also present different criteria for fabric performance. In general it is preferable to use pairs of rolls for which the product of the land areas is between 2% and 20%, even more preferably between 5% and 12%, and for which the ratio of land areas is less than 5 to 1.

We claim:

1. In a method of making a thermally segmentally bonded non woven fabric comprising compressing a fibrous web containing distributed thermally bondable material between two members whose opposed cooperating surfaces each have different surface land patterns heated sufficiently to activate the thermally bondable material in contact with them, the improvement comprising using regular patterns of lands which are isolated discontinuous projections spaced-apart on all sides from adjacent projections opposed pairs of lands, one on each member, differing from at least some other such pairs in their degrees of relative register in two directions at right angles the differences in register between different opposed pairs of lands ranging in each direction from zero to half of the corresponding interland spacings whereby uncontrolled variations in register between the members as a whole cause no visible difference in the segmental bond pattern in the resultant fabric and no intermeshing can occur between the members.

2. A method according to claim 1 in which the members are rolls.

3. A method according to claim 2 in which the lands on both rolls form rows in close or overlapping echelon inclined to the direction of the nip between the rolls whereby as the rolls rotate there are always some pairs of lands in face to face contact in the nip serving to withstand the nip pressure.

4. A method according to claim 1 in which the product of the aggregate land areas of each of the two members expressed as a percentage of their total areas is between 2% and 20%.

5. A method according to claim 4 in which the product of the land areas is between 5% and 12%.

6. A method according to claim 1 in which the ratio of the aggregate land areas of the two members is less than 5:1.

7. A method according to claim 1 in which the distributed thermally bondable material is present as fibres.

8. A method according to claim 7 in which the web comprises thermally bondable fibres and also fibres which do not soften at the temperature used to activate the thermally bondable fibres.

9. A method according to claim 7 in which the distributed thermally bondable material is present as the sheaths of bicomponent fibres which have cores which do not soften at the temperature used to activate their sheaths.

10. A method according to claim 9 in which the web comprises also fibres which do not soften at the temperature used to activate the bondable bicomponent fibres.

11. A method according to claim 1 in which at least a substantial proportion of the fibres used to form the web is uncrimped.

12. A method according to claim 1 in which the fibres used to form the web have less than 2 crimps per centimetre.

13. A method according to claim 1 in which the product of the aggregate land areas of the two members expressed as percentages of their total areas is between 2% and 20% and in which the ratio of the aggregate land areas of the two members is less than 5:1, and in which the distributed thermally bondable material is present as the sheaths of bicomponent fibres which have cores which do not soften at the bonding temperature and in which at least a substantial proportion of the fibres used to form the web is uncrimped.

14. A method according to claim 1 in which the product of the aggregate land areas of the two members expressed as percentages of their total areas is between 2% and 20 % and in which the ratio of the aggregate land areas of the two members is less than 5:1, and in which the distributed thermally bondable material is present as the sheaths of bicomponent fibres which have cores which do not soften at the bonding temperature and in which the fibres used to form the web have less than 2 crimps per centimeter.

* * * * *

UNITED STATES PATENT OFFICE

CERTIFICATE OF CORRECTION

Patent No. 4,005,169 Dated January 25, 1977

Inventor(s) David Charles Cumbers

It is certified that error appears in the above-identified patent and that said Letters Patent are hereby corrected as shown below:

In the heading:

Item [30] should read:

--Foreign Application priority data

April 26, 1974 United Kingdom .....18326/74 and
November 1, 1974 United Kingdom .....47356/74
and Complete Specification No. 18326, filed April 11, 1975--

Signed and Sealed this

Tenth Day of May 1977

[SEAL]

*Attest:*

RUTH C. MASON
*Attesting Officer*

C. MARSHALL DANN
*Commissioner of Patents and Trademarks*